United States Patent [19]

LaChance

[11] 4,445,659

[45] * May 1, 1984

[54] COMBINATION BRACKET AND ADJUSTABLE LADDER TRAY

[76] Inventor: Paul LaChance, 100 Division St., Rockland, Mass. 02370

[ * ] Notice: The portion of the term of this patent subsequent to Apr. 1, 1996 has been disclaimed.

[21] Appl. No.: 910,382

[22] Filed: May 30, 1978

[51] Int. Cl.[3] ..... E06C 7/14

[52] U.S. Cl. ..... 248/210; 182/120

[58] Field of Search ..... 248/210, 238; 211/60 T; 108/26; 182/214, 120, 121

[56] References Cited

U.S. PATENT DOCUMENTS

| | | | |
|---|---|---|---|
| 3,059,723 | 10/1962 | Shore | 248/210 |
| 3,223,369 | 12/1965 | Benninger, Jr. | 248/210 |
| 3,229,943 | 1/1966 | Olson | 248/210 |
| 3,495,683 | 2/1970 | Broden | 248/210 X |
| 3,642,239 | 2/1972 | Zeiler, Jr. | 248/210 |
| 3,985,203 | 10/1976 | Erlenbach | 248/210 X |

FOREIGN PATENT DOCUMENTS

| | | | |
|---|---|---|---|
| 683720 | 12/1952 | United Kingdom | 248/210 |

*Primary Examiner*—William E. Lyddane
*Assistant Examiner*—Peter A. Aschenbrenner
*Attorney, Agent, or Firm*—Donald W. Meeker

[57] ABSTRACT

A combination bracket and adjustable ladder tray for holding the tools and materials of a tradesman in close proximity to his area of work while he is working on an extension ladder. The device of this invention includes a tray contoured to fit the most commonly used tools and materials of the tradesman, apparatus for securing these tools in said tray and a support bracket which on one side is adjustably secured to the base of said tray and on the other side has provision for secure attachment within the hollow rungs of an extension ladder. The tray is adjustable so that it can be always level relative to the ground or in any other angular position, regardless of the angle at which the ladder is placed against a structure.

5 Claims, 3 Drawing Figures

COMBINATION BRACKET AND ADJUSTABLE LADDER TRAY

BACKGROUND OF THE INVENTION

1. Field of the Invention

This invention pertains to combination brackets and adjustable ladder trays which are designed for attachment to ladders by means of horizontal rods, inserted into the hollow rungs of said ladders, the tray being adjustable on the bracket to maintain the tray substantially parallel to the ground or at any desired angle, regardless of the ladder, and the tray being contoured to hold securely the tools and supplies of a tradesman working on the ladder.

2. Description of the Prior Art

Brackets and shelves for ladders to hold tools and materials of tradesmen have been designed and developed for years. Most of such prior art devices have been of a special purpose design, such as hooks for paint cans, holders for specific tools and the like. Many of the prior art devices have lacked stability in position on the ladder. Many have not been readily adaptable to a change of use. Many require removal and reattachment when the ladder is repositioned. The purpose of this invention is to provide a ladder tray contoured to accept all commonly and frequently used tools and supplies of the tradesman and to secure said tools and supplies therein or thereon; to provide means to adjustably secure said tray to a ladder mounting bracket such that said tray may be positioned at an angle desired by the tradesman, which is usually substantially parallel to the ground level; and a mounting bracket which may be easily secured and removed from either side of a ladder and, when said bracket is attached to the ladder, it is very securely attached thereto. Thus, the design criteria for a combination bracket and adjustable ladder tray are stability of the tray and bracket on the ladder; secure adjustment of the bracket to the ladder and the tray on the bracket; a heavy duty device to handle a variety of tools and materials; a versatile device to make it useufl for a wide variety of tradesmen, and primarily a device that is easy to use and inexpensive to manufacture. The device of this invention meets all these criteria.

SUMMARY OF THE INVENTION

This invention pertains to a combination bracket and adjustable ladder tray whereby a tradesman may use said tray to hold in a secure manner the tools and materials he is using while working on a ladder, whereby the tradesman may adjust the level of the tray to be substantially parallel to a ground level reference or at any angle he desires. The tray of this invention is adjustably secured to one side of a horizontal pipe structure whereby the tray is pivotally supported on said bracket and its level may be adjusted in its plane of reference. The other side of the bracket is a horizontally-oriented U-shaped pipe structure which is used to secure the bracket to the hollow rungs of a ladder. The upper leg of the U-shaped pipe structure is a continuation of the tray support pipe structure and is an elongated pipe member which fits through the opening in a hollow ladder rung, extending slightly outward therethrough. Beyond the outer perimeter of the ladder a small hole is positioned through this pipe member for the insertion of a nail, cotter pin or the like to prevent the upper leg of said pipe structure from being accidentally withdrawn from said ladder rung. The lower leg of said U-member pipe is of a shorter length and is simply inserted within the next lower hollow rung of the ladder for stability. The base leg of the U-shaped portion of this pipe structure connects the two horizontally-oriented legs and fits snugly along the vertical external perimeter of the ladder between the two adjacent rungs in which the horizontal legs are inserted. The ladder bracket is designed to fit ladders which have hollow rungs. Since the ladder bracket is symmetrical, with the tray secured to one side and the ladder attachment means to the other side, the combination ladder bracket and adjustable tray may be attached to either side of the ladder, depending on the requirements of the tradesman. The side of the bracket which supports the tray is also pipe shaped and is positioned under the lateral axis of the tray. The various pipe members which form the pipe structure are connected by conventional threaded pipe joints. The end of the tray support pipe is an end pipe fitting. The tray is secured to the support pipe by a pair of U-shaped brackets which are bolted to the base of the tray and are secured around pipe joints or fittings. By loosening the wing nuts on the bolts of the inner one of said U-shaped brackets, the tray may be tilted to the desired angle. This tilt is possible because the tray support pipe is loosely threaded into its end fitting. By tightening these two wing nuts, the tray is secured at the desired angle. As the angle of inclination of the ladder to the structure is changed, the level of the tray may be easily changed. An optional arcuate-shaped support bracket may be used to vary the angle of the tray to the bracket. However, this arcuate support limits the versatility of the device since it pivots only through an arc of ninety degrees and the combination bracket and ladder tray is not reversible when it is installed.

The tray itself is part of the novel configuration of this device. It can be fabricated in different sizes to fit the tools and materials of various tradesmen. Basically, it is a rectangular shaped structure having a base and four low side walls. Provision is made for adjustment bolts to protrude through the base to adjust the angle of the base of the tray. Since the tray will be used extensively by painters, it is sized and contoured to accomodate a paint tray for roller painting. Such a paint tray has an upward inclining corrugated surface and L-shaped base legs under its upward inclining surface. A bar is positioned laterally across one end of the tray to support the upward inclined end of the paint tray in a stable position. Two slots are provided at the base of said bar so that the base members of the L-shaped legs of the paint tray may be slipped therethrough to increase further the stability of paint tray within the ladder tray. A plurality of tool holding brackets may be secured to the outside perimeter walls of the ladder tray to permit the tradesman to place his tools on the tray without dropping them. The tray may be used by painter, carpenters, electricians, shinglers and a variety of other tradesmen since it will support a variety of tools and materials. In an alternate embodiment the tray may simply be a print roller tray modified to fit the bracket.

DESCRIPTION OF PREFERRED EMBODIMENT

Figure 1:
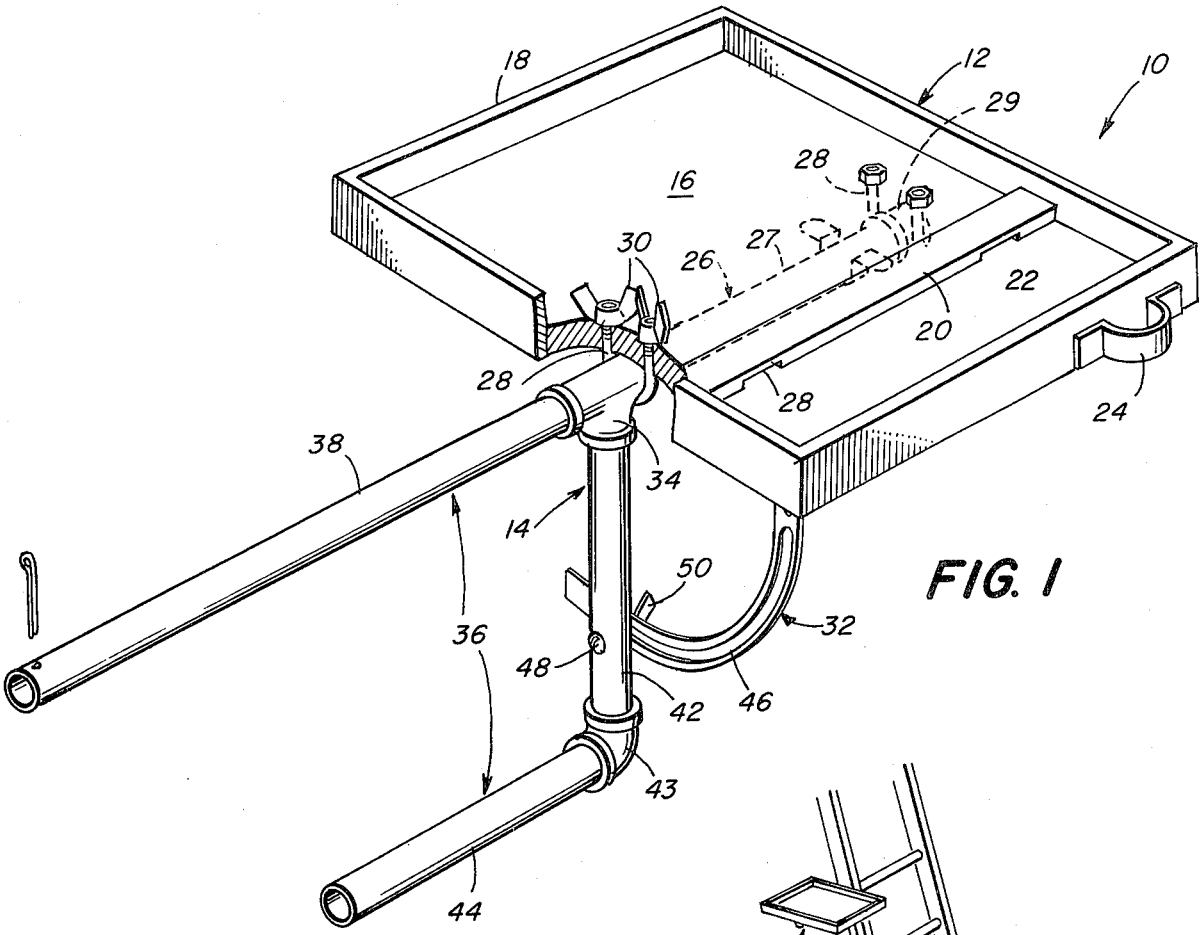
FIG. 1 is a perspective view of the combination bracket and adjustable ladder tray of this invention.
Figure 2:
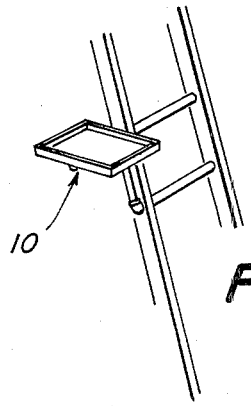
FIG. 2 is a perspective view of the combination bracket adjustable ladder tray of this invention in position on a ladder.

Referring now to the drawings, FIG. 1 is a perspective view of the combination bracket and adjustable ladder tray of this invention, designated generally by the reference numeral 10. This combination device 10 consists of two basic parts, a tray 12 and a bracket 14.

Tray 12 may be of many varying sizes to accomodate the needs of the individual tradesman and to accomodate his tools and equipment. Basically tray 12 is rectangular in shape having a base 16 and four side walls 18. The base of tray 12 further includes a laterally extending horizontal bar 20 which is positioned and sized to support the underside of an upward-inclined, corrugated base of a roller paint tray. Bar 20 also has two slots 22 in its base to accomodate the inward base of the L-shaped legs of a paint tray. Sidewalls 18, bar 20 and slots 22 enable the tradesman to position a conventional roller paint tray in ladder tray 12 very securely and with virtually no chance of the paint tray being accidentally dislodged and spilling its contents. Tray 12 may further include a plurality of tool holding brackets 24 along the exterior perimeter edges of sidewalls 18.

Tray 12 is adjustably mounted on one side of bracket 14. Bracket 14 is basically a horizontally-oriented pipe structure having two half portions, joined together. That portion of bracket 14 which supports tray 12 is designated tray support 26 and is positioned under the lateral axis thereof. Tray support 26 includes a pipe member 27 thread at its inner end to T-fitting 34 and at its outer end to end fitting 29. Tray 12 is secured to pipe support 26 by a plurality of U-shaped brackets 28, one surrounding an end of T-fitting 34 and one surrounding end fitting 29. Pipe segment 27 is loosely threaded into end fitting 29 to permit it to rotate as tray 12 is tilted. The inner U-shaped bracket has wing nuts 30, nuts protruding through base 16 of tray 12. By loosening said wing nuts 30 tray 12 can be pivoted about pipe support 26. By tightening said wing nuts 30, tray 12 is tightly secured to pipe support 26.

An optional arcuate bracket 32 having a groove the length thereof may be secured to the underside of tray base 12 and used as an additional support and adjustment means as described hereinafter.

Tray support pipe 26 is joined to the other portion 36 of bracket 14 by a T-joint 34. Bracket portion 36 is a horizontally-oriented U-shaped pipe structure having an elongated upper pipe leg 38 coplanar with tray support pipe 26 and connected thereto through T-joint 34. Upper pipe leg 38 is of sufficient length to extend through the opening of a hollow ladder rung and of a diameter to fit snugly therethrough. Upper pipe leg 38 has a hole 40 therethrough to permit the insertion of a cotter pin, nail, bolt or the like to prevent the accidental withdrawal of upper pipe leg 38 from the interior of the ladder rung. Bracket portion 36 has a vertically extending pipe member 42 centrally located and extending downward from T-member 34 to a second horizontal pipe leg 44, which is positioned to fit into the hollow ladder rung immediately below the rung in which upper pipe leg 38 is positioned. Pipe leg 44 need not extend through the ladder rung, but must be long enough to make bracket portion 36 stable when inserted into adjacent ladder rungs.

As described to this point, combination bracket and adjustable ladder tray 10 may be attached to either side of any ladder having hollow rungs and the level of the tray 12 may easily be adjusted to the desired position relative to the inclination of the ladder by loosening and tightening wing nuts 30. Effectively, tray 12 may pivot through an arc of 180° as the tray and bracket combination 10 is moved from one side of the ladder to the other for the convenience of the tradesman. Thus, as described so far, device 10 is symmetrical in use.

An optional support and adjustment member in the form of an arcuate bracket 32 which has an arc of 90° may be secured at one end to the underside of tray base 16 and at its other end to vertical pipe member 42. Arcuate bracket 32 has a groove 46 within it which permits the shaft of a bolt to slide virtually its entire length. A bolt 48 extending through vertical pipe member 42, groove 46 and held in position by wing nut 50 serves to adjust the level of tray 12 bracket 14. However, the combination device 10 may not be used on both sides of the ladder without repositioning arcuate bracket 32.

The dual legs 38, 44 connected by T-joint 34, vertical leg 42, elbow joint 43 and lower base leg 44 combine to provide a high degree of stability on the ladder and make the bracket a heavy duty bracket which can support significant weight while remaining easy to use and inexpensive to manufacture. Tray 12 is particulary versatile since it is specifically designed to support a roller paint tray with great stability. When not in use for a roller tray, it provides ample room for other tools and materials and serves as a compartmented tray. Additionally, the pipe structure of the bracket provides a means to permit tray 12 to pivot or tilt to any desired angle. Thus, tray 12 also becomes stable both with respect to the ladder and with respect to the ground reference level. Tray 12 can be a heavy duty tray, a versatile tray and its adjustment means is very easy to use. Thus, the combination bracket and adjustable ladder tray of this invention is a novel combination which meets all the design criteria specified above.

Obviously, alternate means of securing tray 12 to bracket 14 may be utilized to avoid wing nuts 30 protruding into tray 12.

Bracket 14 may be attached to wooden ladders without hollow rungs by clamps.

Figure 3:
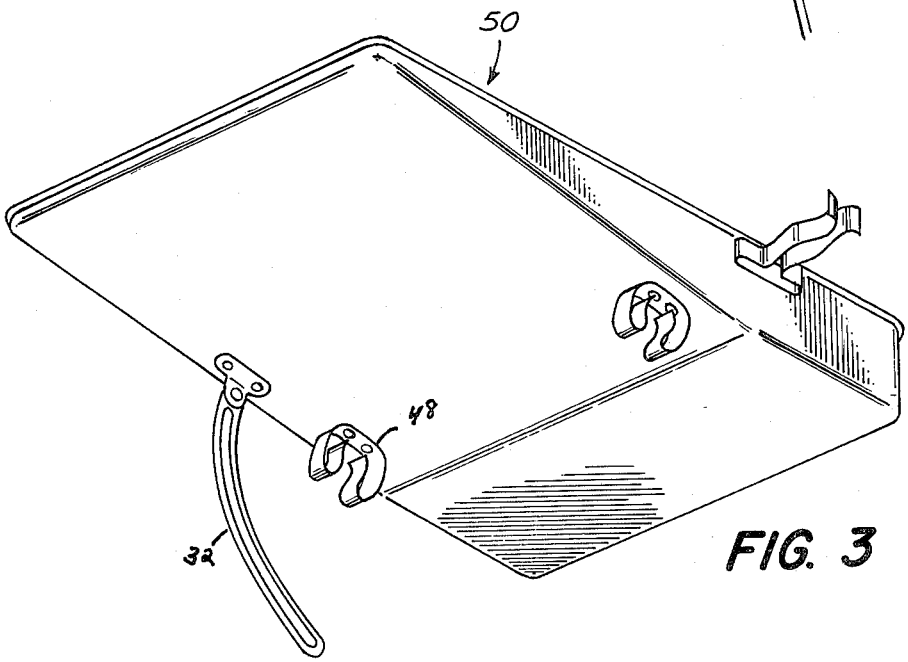
FIG. 3 is a perspective view of a paint roller tray modified to fit the bracket of this invention.

In an alternate embodiment, tray 12 may be simply a paint roller tray, as shown in FIG. 3, modified to fit pipe support bracket 26. In this embodiment, the base of the roller tray 50 is furnished with a plurality of U-shaped spring clips 48 which fit pipe segment 27 and arcuate bracket 32 must be secured to the base of roller tray 48. If pipe segment 27 is elongated both tray 12 and roller tray 48 may be fitted on bracket 14.

This device 10 is an adjustable combination ladder tray and bracket 10. Tray 12 is adjustable so to its level relative to the ground on bracket portion 20 and bracket portion 36 is adjustable on hollow ladder rungs. While I have described and illustrated herein the preferred embodiment of my invention, it should be obvious to those skilled in the art that many variations may be made therein while remaining within the scope of the appended claims.

I claim:

1. A combination adjustable ladder tray and bracket for attachment to the hollow rungs of a ladder comprising in combination:

a bracket means comprising two horizontally oriented pipes joined together by a threaded T-joint;

the first of said horizontal pipe members serving as a ladder attachment means;

the second of said horizontal pipe members serving as a tray support means, and terminating in a threaded pipe end fitting;

a vertical pipe member joined to the open end of said T-joint and extending downward therefrom;

a third horizontal pipe member joined to said vertical pipe member by an elbow joint and extending horizontally under said first horizontal pipes;

said second and third horizontal pipes being spaced apart such that they fit within two adjacent hollow rungs of a ladder and form a ladder attachment means;

said second upper horizontal pipe member being of sufficient length to extend through the upper adjacent ladder rung;

said second upper horizontal pipe member having a hole therethrough at its extreme end to receive an elongated vertical member to prevent the accidental withdrawal of said pipe member through said ladder rung;

a tray of substantially rectangular shape having a base and 4 upward extending sides adjustably secured to said first upper horizontal pipe support member;

said first upper horizontal pipe member being secured to the underside of a tray base by two U-shaped brackets, one positioned under said T-member and one positioned under a threaded pipe termination member;

both of said U-shaped brackets secured to said tray base by bolts and nuts such that the nuts of said inner bracket may be tightened and loosened to permit the plane of said tray base to pivot about said horizontal pipe support member;

said tray being contoured to hold and support various tools and supplies of a tradesman working on a ladder;

a bar extending laterally across the inside base of said tray, said bar being sized and positioned to support the upward inclining corrugated base of a roller paint tray base when a roller tray is placed in said tray;

a pair of slots in the base of said lateral bar to receive the inward extending portion of the L-shaped legs of a roller paint tray to secure said paint tray in said ladder tray.

2. The combination bracket and adjustable ladder tray of claim 1 wherein said device further includes:

at least one tool holder secured to said ladder tray.

3. The adjustable ladder tray and bracket of claim 1 further comprising:

an arcuate bracket secured at its upper end to the base of said tray and at its lower end to said vertical pipe segment;

a groove in said arcuate bracket such that the angle of inclination of said tray may be changed by sliding and securing a bolt through said groove.

4. A combination adjustable ladder tray and bracket for attachment to the hollow rungs of a ladder comprising in combination:

a bracket means comprising a rigid horizontal U-shaped tubular structure having one leg of the U longer than the other, wherein both legs are inserted into the hollow rungs of the ladder and the longer leg extends completely through the rung, wherein the long leg is secured by a removable attaching means at an outer end of the long leg;

the bracket means further comprised of a straight rigid extension arm of the longer leg protruding outwardly from the ladder;

a tray adjustably attached to the rigid extension arm by rotatable clamping means which tray may be adjusted to any desired angle relative to the ladder, which tray comprises a flat bottom provided with side walls upon which walls at least one tool holder is secured;

an arcuate bracket secured at its upper end to the base of said tray and at its lower end to said U-shaped tubular structure and a groove in said arcuate bracket such that the angle of inclination of said tray may be changed by sliding and securing a bolt through said groove.

5. A combination adjustable ladder tray and bracket for attachment to the hollow rungs of a ladder comprising in combination:

a bracket means comprising a rigid horizontal U-shaped tubular structure having one leg of the U longer than the other, wherein both legs are inserted into the hollow rungs of the ladder and the longer legs extends completely through the rung wherein the long leg is secured by a removable attaching means at the outer end of the long leg;

the bracket means further comprised of a straight rigid extension arm of the longer leg protruding outwardly from the ladder;

a tray adjustably attached to the rigid extension arm by rotatable clamping means which tray may be adjusted to any desired angle relative to the ladder and which tray comprises a paint roller tray;

an arcuate bracket secured at its upper end to the base of said tray and at its lower end to said U-shaped tubular structure; and a groove in said arcuate bracket such that the angle of inclination of said tray may be changed by sliding and securing a bolt through said groove.

* * * * *